US006184768B1

(12) United States Patent
Hsu

(10) Patent No.: US 6,184,768 B1
(45) Date of Patent: Feb. 6, 2001

(54) THERMAL ACTUATOR

(76) Inventor: Cheng Chao Hsu, 1650, 8th Ave., #203, San Diego, CA (US) 92101

( * ) Notice: Under 35 U.S.C. 154(b), the term of this patent shall be extended for 0 days.

(21) Appl. No.: 09/216,069

(22) Filed: Dec. 19, 1998

(51) Int. Cl.[7] ..... H01H 37/52; H01H 37/32

(52) U.S. Cl. ..... 337/363; 337/33; 337/318; 337/365

(58) Field of Search ..... 337/363, 77, 78, 337/100, 101, 102, 107, 141, 333, 370, 377, 381, 318, 365, 390, 89, 131, 362

(56) References Cited

U.S. PATENT DOCUMENTS

| | | | | |
|---|---|---|---|---|
| 1,996,720 | * | 4/1935 | Getchell | 337/107 |
| 2,302,924 | * | 11/1942 | Valverde | 236/68 R |
| 2,605,339 | * | 7/1952 | Connolly | 340/870.09 |
| 2,635,156 | * | 4/1953 | Welter | 337/141 |
| 2,763,750 | * | 9/1956 | Adams et al. | 337/78 |
| 3,066,206 | * | 11/1962 | Dales | 337/372 |
| 3,087,146 | * | 4/1963 | Boudouris | 340/332 |
| 3,107,281 | * | 10/1963 | Tufts | 200/38 D |
| 3,258,647 | * | 6/1966 | Clark | 361/105 |
| 3,458,675 | * | 7/1969 | Del Gaudio | 200/61.64 |
| 3,569,887 | * | 3/1971 | Brown | 337/77 |
| 4,347,709 | * | 9/1982 | Wu et al. | 62/140 |
| 5,402,099 | * | 3/1995 | Ballard et al. | 337/298 |

* cited by examiner

*Primary Examiner*—Leo P. Picard
*Assistant Examiner*—Anatoly Vortman
(74) *Attorney, Agent, or Firm*—Raymond Y. Chan; David & Raymond

(57) ABSTRACT

A thermal actuator includes a thermal detector, an actuator unit and a connecting circuit for electrically connecting the thermal detector in parallel with the actuator unit. The thermal detector includes a first contact member and a second contact member normally remained in contact with the first contact member. However, the second contact member will bend to uncontact with the first contact member when an overheated or over-cold temperature occurred around the thermal detector, so that the current normally flowing through the thermal detector will flow to the actuator unit too. Therefore, a heat wire wrapped around an actuating piece of the actuator unit generates heat to increase the temperature around the actuating piece. When the temperature around the actuating piece increases to a predetermined extent, the actuating piece bends so as to provide an actuating action. If the actuator unit is installed close to a switch or a breaker, the actuating action of the actuating piece can activate the switch to turn off or the jumper of the breaker to cut the electric supply.

20 Claims, 5 Drawing Sheets

THERMAL ACTUATOR

CROSS REFERENCE OF RELATED APPLICATION

The present invention is an improvement of a previous application, Ser. No. 09/122,371, filed Jul. 27, 1998, now allowed.

FIELD OF THE PRESENT INVENTION

The present invention relates to a kind of actuator, and more particular to a thermal actuator which comprises a thermal detector and an actuator unit electrically connected together in parallel manner, wherein the actuator unit can automatically provide an actuating action once the temperature of a predetermined surrounding zone is detected overheat or over-cold by the thermal detector. It is a universal device adapted to the overheat or over-cold of various apparatus and appliances, such as an electrical circuit breaker, a motor, a refrigerator, a freezing storage, a coffee maker, a heater, a computer, and etc.

BACKGROUND OF THE PRESENT INVENTION

Most electrical appliances break down because of overheating. Overheating of an appliance or a circuit frequently causes fire or electrical shock. In order to provide a kind of protection, most houseware appliances install a fuse or a thermo cut off to prevent the overheating of the electrical wires. However, both the fuse and the thermo cut off are one time use only and can not be reset to use again. In other words, once the fuse or the thermo cut off is functioned to cut off the electric circuit, it must be replaced by a new one before the electrical appliances can function again. For the building circuitry, the bi-metal type breaker is the most common device installed in the control panel to prevent the overheating of the electrical wiring.

In other words, those conventional thermal protectors are substantially the electrical current protection to prevent overheating of the electrical wiring. However, the surrounding around the electrical appliance has nothing to protect against overheated or over-cold. For example, a pot of a coffer maker may also be overheated if there is no more coffee therein. It will also create danger of fire or breaking down situation. A halogen floor lamp would generate a great amount of heat therearound that has a high risk of burning stuff like the curtain around.

The surge protector is the most common MOV (metal oxide varistors) utilized in various electrical appliances. However, due to the fluctuation of the voltage, it may easily generate great amount of heat and may also result in explosion.

Moreover, it is well known that the CPU of a computer generates heat during operation. If the heat around the CPU accumulates to a certain extent, the CPU will be malfunctioned. Also, a heater is an appliance for generating heat. However, the user can only control the heat by setting the power output or the timer control. It is relatively expensive and difficult to control the heater according to the actual temperature around the heater.

In fact, every electrical appliance that generates heat needs a thermal guard to prevent the surrounding being overheated or over-cold. It would be a remarkable matter if there is an inexpensive device that can cut the circuit or switch off the appliance if the surrounding thereof is too hot. It not only can prolong the service life of the appliance, but also can help the user to avoid unreasonable hazard or damages.

Moreover, it would be a more advance concept to have a thermal actuator, which can easily connect with the electrical circuit of an electrical appliance without affecting the original circuit or sharing its voltage power. Besides, how to connect more than one set of thermal actuators or more than one thermal detectors thereof becomes another important and practical problem pending to be solved.

SUMMARY OF THE PRESENT INVENTION

It is thus a main object of the present invention to provide a thermal actuator adapted to provide an actuating action to break a circuit or to switch off the appliance when the temperature of a predetermined surrounding zone is higher than a safe temperature, wherein the thermal actuator comprises at least a thermal detector and at least an actuator unit electrically connected in parallel manner with the electrical circuit of the appliance.

A further object of the present invention is to provide a thermal actuator which is a universal device adapted for installing to most kinds of electrical circuitry or appliances.

Another object of the present invention is to provide a thermal actuator which can be repeatedly reset to use after the circuit is broken.

Yet another object of the present invention is to provide a thermal actuator adapted to employ with a surge protector, wherein the thermal actuator can prevent the surge protector from dangerous conditions by breaking the circuit urgently before it is overheating.

Yet another object of the present invention is to provide a thermal actuator which has a relatively economic structure and is easy to install.

Still another object of the present invention is to provide a thermal actuator which may comprises more than one thermal detectors parallelly connected with an actuator unit.

Accordingly, in order to accomplish the above objects, the present invention provides a thermal actuator which comprises at least a thermal detector for breaking a current flowing therethrough when a temperature therearound reaches a predetermined temperature, at least an actuator unit, and a connecting circuit for electrically connecting the thermal detector in parallel with the actuator unit.

The thermal detector comprises a first contact member made of electrical conducting material, a second contact member made of thermostatic metal and an insulating connector connected between a connecting end of the second contact member and the first contact member. The second contact member has a contact end normally pressed against and remained in contact with the first contact member. The contact end of the second contact member would bend away from the first contact member so as to render the first and second contact members becoming uncontacted when the temperature around the thermal detector reaches a predetermined temperature. However, when the temperature around the thermal detector cools down to normal, the first and second contact members will automatically reset to the contact condition again.

The actuator unit comprises an actuating piece made of thermostatic metal strip, a conducting terminal piece connected to the actuating piece, an insulating sleeve covering a portion of the actuating piece, and an electrical heat wire wrapping around the insulating sleeve which has one end connected to the actuating piece.

The connecting circuit comprises an input terminal, an output terminal, a first connecting wire electrically connected the thermal detector between the input and output terminals, and a second connecting wire which is extended between the input and output terminals in parallel with the first connecting wire so as to electrically connect the actuator unit between the input and out put terminals.

When the second contact member is normally remained in contact with the first contact member, more than 50% of a main current input at the input terminal of the connecting circuit flows through the thermal detector and less than 50% of the main current flows through the actuator unit. However, when the second contact member bends to uncontact with the first contact member due to overheated or over-cold temperature around the thermal detector, 100% of the main current flows to the actuator unit. The heat wire wrapped the actuating piece generates heat to increase the temperature around the actuating piece. When the temperature around the actuating piece increases to a predetermined extent, the actuating piece bends so as to provide an actuating action. If the actuator unit is installed close to a switch or a breaker, the actuating action of the actuating piece can activate the switch to turn off or the jumper of the breaker to cut the electric supply.

DETAILED DESCRIPTION OF THE PREFERRED EMBODIMENT

Figure 1:
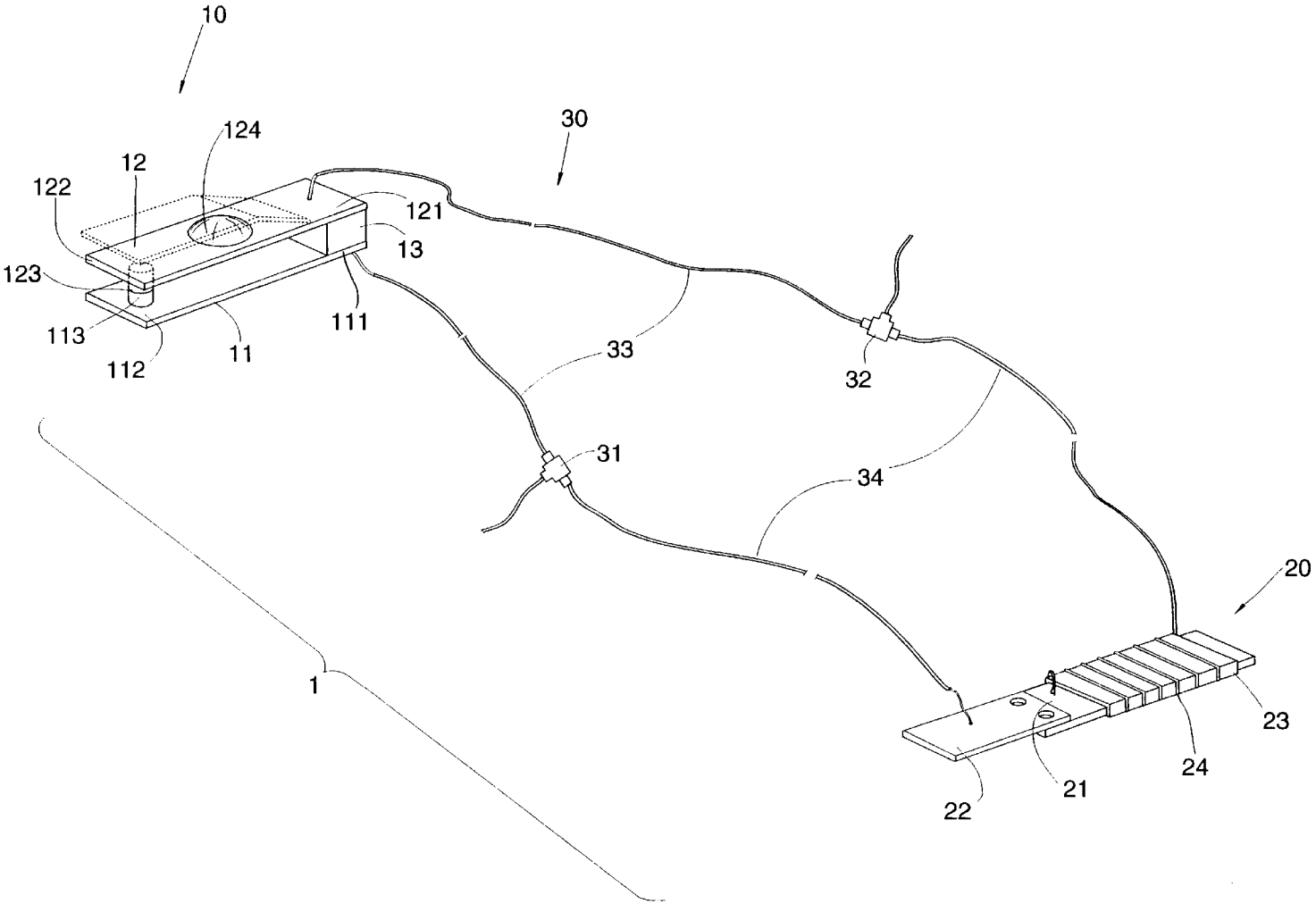
FIG. 1 is a perspective view of a thermal actuator in accordance with a preferred embodiment of the present invention, wherein the dotted lines indicated the displacement of the second member.
Figure 2:
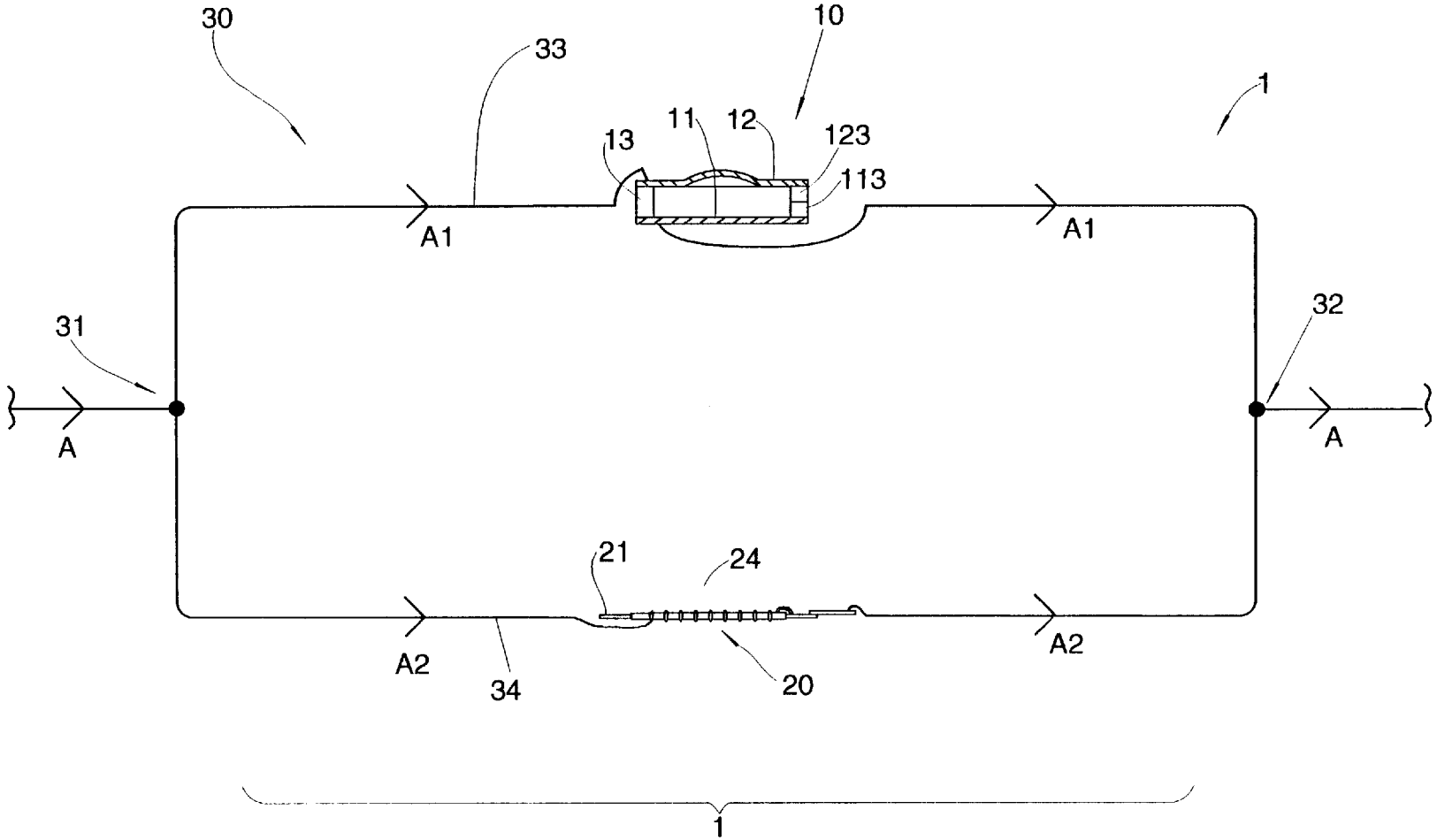
FIG. 2 is a circuit diagram of the thermal actuator when the thermal detector is in contact condition according to the above preferred embodiment of the present invention.

Referring to FIGS. 1 and 2, a thermal actuator 1 according to a preferred embodiment of the present invention is illustrated. The thermal actuator 1 comprises at least a thermal detector 10, at least an actuator unit 20 and a connecting circuit 30 for electrically connecting the thermal detector 10 in parallel with the actuator unit 20.

The thermal detector 10, such as a thermo-regulator, is adapted for breaking a current flowing therethrough when a surrounding temperature around the thermal detector 10 changes from a normal temperature to a predetermined temperature, wherein when the surrounding temperature around the thermal detector 10 returns to the normal temperature, the current flows therethrough again.

According to the preferred embodiment, as shown in FIG. 1, the thermal detector 10 comprises a first contact member 11 made of electrical conducting material such as brass, a second contact member 12 made of thermostatic metal (bi-metal) and an insulating connector 13 connected between a connecting end 121 of the second contact member 12 and a first end 111 of the first contact member 11. A second end 112 of the first contact member 11 protrudes a first contact point 113 facing to the second contact member 12.

The second contact member 12 is normally remained in contact with the first contact member 11. The second contact member 12 has a contact end 122 which protrudes a contact point 123 normally pressed against the first contact point 113. The second contact member 12 would bend away from the first contact member 11 so as to uncontact the first and second contact members 11, 12 when the surrounding temperature around the thermal detector 10, i.e. the second contact member 12, reaches a predetermined temperature. The predetermined temperature depends on the material nature of the second contact member 12. Therefore, the current flowing through the first and second contact members 11, 12 is cut off.

On the second contact member 12, a circular convex groove 124 is formed. Accordingly, when the second contact member 12 is heated by the hot surrounding, the circular convex groove 124 ensures the contact end 122 of the second contact member 12 bending upwardly away from the first contact member 11.

The actuator unit 20 comprises an actuating piece 21 made of thermostatic metal (bi-metal), a conducting terminal piece 22 connected to one end of the actuating piece 21 by spot welding, an insulating sleeve 23 covering a portion of the actuating piece 21, and an electrical heat wire 24 wrapping around the insulating sleeve 23 which has one end 241 connected to the actuating piece 21. The insulating sleeve 23 acts as an insulating layer between the surface of the actuating piece 21 and the heat wire 24 to avoid electrically contact therebetween.

The connecting circuit 30 comprises an input terminal 31, an output terminal 32, a first connecting wire 33 electrically connected the thermal detector 10 between the input and output terminals 31, 32, and a second connecting wire 34 which is extended between the input and output terminals 31, 32 in parallel with the first connecting wire 33 so as to electrically connect the actuator unit 20 between the input and out put terminals 31, 32.

As shown in FIG. 2, the thermal actuator 1 is electrically connected to the electric circuit of an electrical appliance, wherein a main current A of the electrical appliance flows through the thermal actuator 1. Since the thermal detector 10 is connected in parallel with the actuator unit 20, the main current A (for example 15A) is divided into a first current A1 (as large as possible, e.g. 14.8A) to flow through the thermal detector 10 and a second current A2 (as small as possible, e.g. 0.2A) to flow through the actuator unit 20. According to the present invention, the first current A1 must be set to have more than 50% (preferable more than 90%) of the main current A and the second current A2 is set to have less than 50% (preferable less than 10%) of the main current A.

Therefore, as shown in FIG. 2, when the second contact member 12 is normally remained in contact with the first contact member 11, the first current A1 which shares more than 50% (e.g. 14.8A) of the main current A (e.g. 15A) inputs at the input terminal 31 of the connecting circuit 30 and flows through the thermal detector 10. A second current A2 which is less than 50% (e.g. 0.2A) of the main current A flows through the actuator unit 20.

Figure 3:
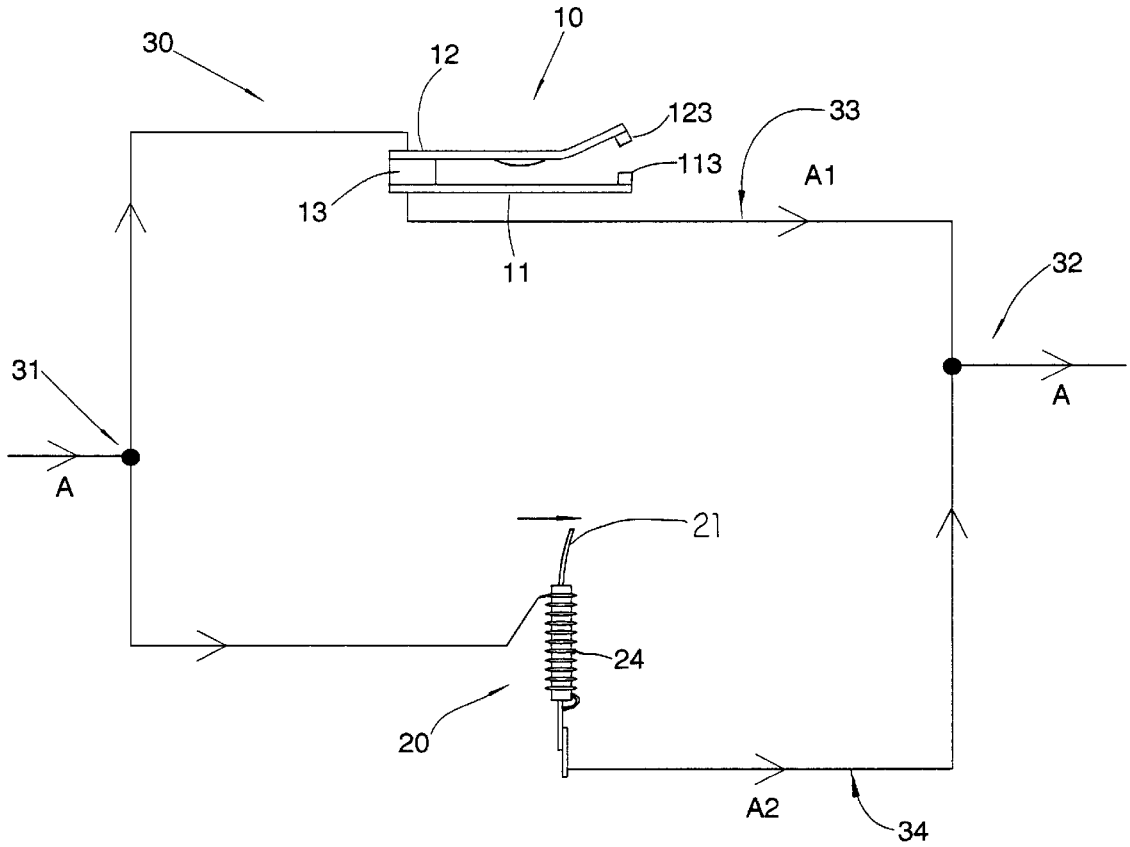
FIG. 3 is a circuit diagram of the thermal actuator when the thermal detector is in uncontact condition according to the above preferred embodiment of the present invention.

However, as shown in FIG. 3, when the second contact member 12 bends to uncontact with the first contact member 11 due to the overheat or over-cold temperature around the thermal detector 10, the first connecting wire 33 breaks and the first current A1 becomes 0 A. Therefore, 100% of the main current A (15A) will flow to the actuator unit 20 via the second connecting wire 34. In other words, the second current A2 equals to the main current A (i.e. 15A). Due to the immediately increased of the second current A2 (such as from 0.2A to 15A), the heat wire 24 wrapped the actuating piece 21 generates heat to increase the temperature around the actuating piece 21. When the temperature around the actuating piece 21 increases to a predetermined extent, the actuating piece 21 bends so as to provide an actuating action. If the actuator unit 20 is installed close to a switch or a breaker, the actuating action of the actuating piece 21 can activate the switch to turn off or the jumper of the breaker to cut the electric supply.

For easy connecting, both the input terminal 31 and the output terminal 32 can be made of three way quick connector, as shown in FIG. 1. Therefore, the user may separately install the thermal detector 10 and the actuating unit 20 respectively, and then electrically connect them in parallel manner by connecting two ends of each of the first and second connecting wires 33, 34 with the input and output terminals 31, 32 respectively.

Figure 4:
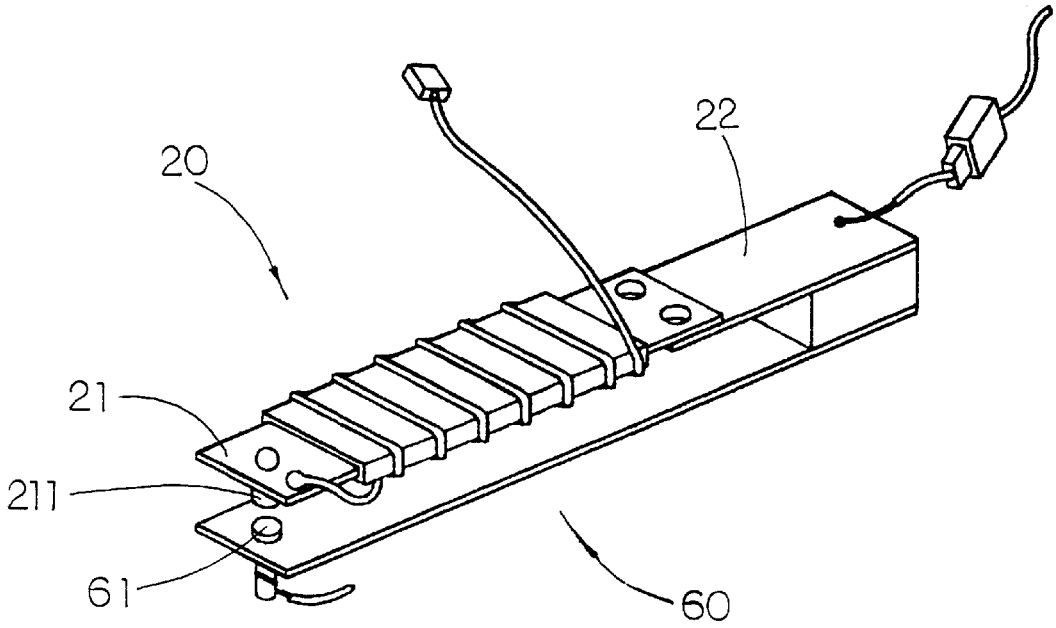
FIG. 4 is a perspective view of the actuator unit installed to a switch contact according to the above preferred embodiment of the present invention.

As shown in FIG. 4, the actuator unit 20 can be embodied to mounted on top of a switch contact member 60 having a switch contact point 61, so that when the actuating piece 21 bends downwardly, an actuating contact point 211 connected to a front end thereof will be rendered to contact with the switch contact point 61 to switch on an appliance (not shown) connected with the switch contact member 60.

Figure 5:
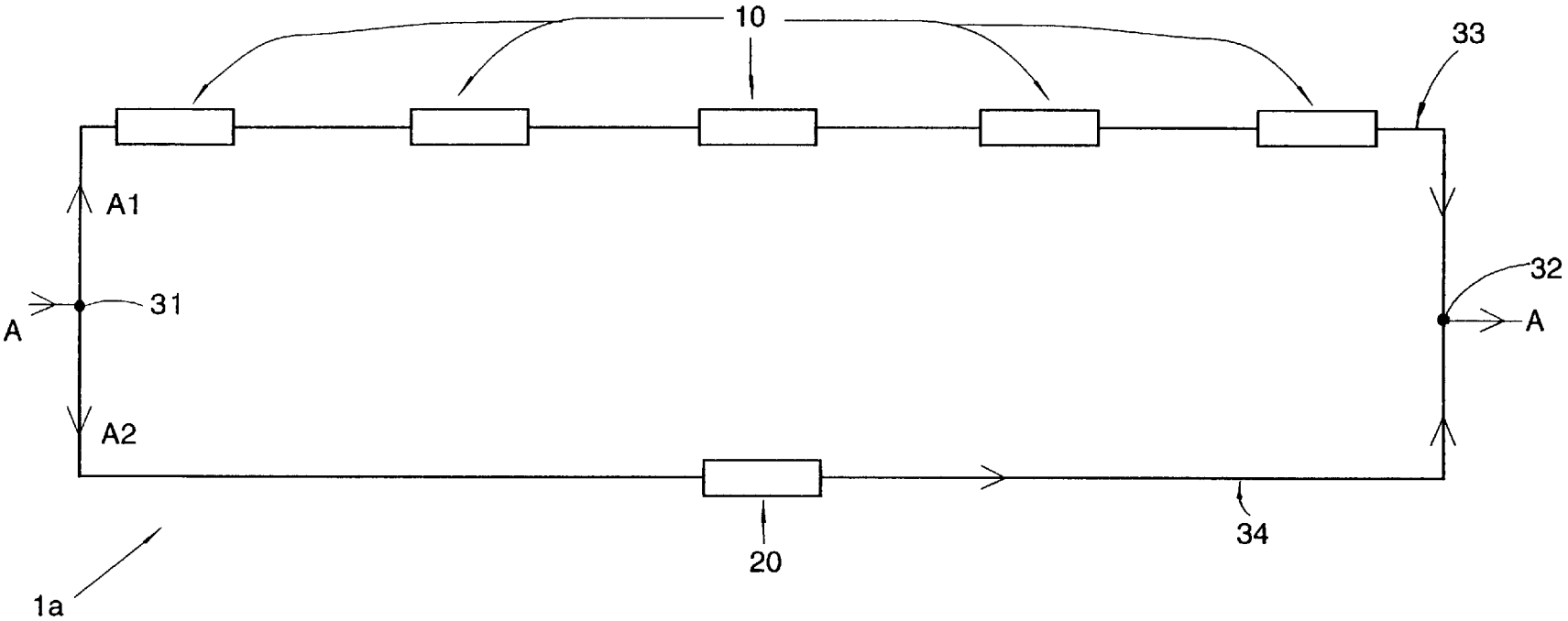
FIGS. 5 illustrates an alternative mode of the thermal actuator according to the above preferred embodiment of the present invention.

FIG. 5 illustrates an alternative mode of the thermal actuator 1*a* of the present invention, wherein a plurality of thermal detectors 10 are connected in series, which are further connected in parallel with an actuator unit 20, wherein the thermal detectors 10 are adapted to install at various heat generating areas of an electrical arrangement. When any one of the thermal detectors 10 detects overheat or overcold therearound, the respective thermal detector 10 breaks the first current A1 flowing through the first connecting wire 33. Similarly, the entire main current A flows through the actuator unit 20 to provides an actuating action.

The parallel arrangement of the thermal detectors 10 and the actuator unit 20 enables the thermal actuator 1 of the present invention to incorporate more than one thermal detectors 10 and/or more than one actuator units 20 without affecting the voltage loading of the electrical appliance.

In view of the above disclosure, the thermal actuator 1 of the present invention substantially provides an actuating action when the surrounding around the thermal detector 10 suffers an overheat or overcold problem. The designer of the appliance can free to take advantage of this actuating action for responding the overheat condition. Since the actuator unit 20 that actually provides the actuating action can be installed far away from the thermal detector 10, it is possible to freely attach the thermal detector 10 to any desired location. Therefore, it should be noticed that the thermal actuator 1 can be incorporated with all kinds of electrical circuitry or appliance, such as an electrical circuit breaker, a circuit protector, a motor, a refrigerator, a freezing storage, a coffee maker, a heater, a computer, and etc.

What is claimed is:

1. A thermal actuator, comprising:

at least one thermal detector for breaking a first current flowing therethrough when a surrounding temperature around said thermal detector changes from a normal temperature to a predetermined temperature;

at least one actuator unit which comprises an actuating piece made of thermostatic metal, a conducting terminal piece connected to said actuating piece, an insulating sleeve covering a portion of said actuating piece, and an electrical heat element wrapping around said insulating sleeve which has one end connected to said actuating piece; and a connecting circuit for electrically connecting said thermal detector in parallel with said actuator unit, wherein said connecting circuit comprises a first terminal, a second terminal, a first connecting wire electrically connected said thermal detector between said first and second terminals, and a second connecting wire which is extended between said first and second terminals in parallel with said first connecting wire to electrically connect said actuator unit between said first and second terminals by connecting another end of said electrical heat element to said first terminal and connecting said conducting terminal piece to said second terminal, wherein a main current flowing through said input terminal and said output terminal is divided into said first current flowing through said thermal detector and a second current flowing through said actuator unit;

whereby when said first current of said first connecting wire flowing through said thermal detector breaks, said main current completely flows through said second connecting wire via said electrical heat element of said actuator unit so as to increase temperature around said actuating piece until said actuating piece provides an actuating action.

2. A thermal actuator, as recited in claim 1, wherein said thermal detector enables said first current to flow therethrough again when said surrounding temperature around said thermal detector returns to said normal temperature, said thermal detector comprising a first contact member made of electrical conducting material, a second contact member made of thermostatic metal and an insulating connector connected between a connecting end of said second contact member and said first contact member, wherein said second contact member is normally remained in contact with said first contact member, however when said surrounding temperature around said thermal detector reaches said predetermined temperature, said contact member bends away from said first contact member to uncontact with said first contact member.

3. A thermal actuator, as recited in claim 2, wherein on said second contact member, a circular convex groove is formed, so that when said second contact member is heated by a hot surrounding, said circular convex groove ensures said contact end of said second contact member bending away from said first contact member.

4. A thermal actuator, as recited in claim 3, wherein an end of said first contact member protrudes a first contact point facing to said second contact member and said second contact member has a contact end which protrudes a contact point arranged to normally in contact with said first contact point.

5. A thermal actuator, as recited in claim 1, wherein said first current contains more than 50% of said main current said second current contains less than 50% of said main current.

6. A thermal actuator, as recited in claim 2, wherein said first current contains more than 50% of said main current said second current contains less than 50% of said main current.

7. A thermal actuator, as recited in claim 3, wherein said first current contains more than 50% of said main current said second current contains less than 50% of said main current.

8. A thermal actuator, as recited in claim 1, wherein said first current contains 90% or more than said main current said second current contains 10% or less than said main current.

9. A thermal actuator, as recited in claim 2, wherein said first current contains 90% or more than said main current said second current contains 10% or less than said main current.

10. A thermal actuator, as recited in claim 3, wherein said first current contains 90% or more than said main current said second current contains 10% or less than said main current.

11. A thermal actuator, as recited in claim 4, wherein said first current contains 90% or more than said main current said second current contains 10% or less than said main current.

12. A thermal actuator, comprising:

a plurality of thermal detectors electrically connected in series for breaking a first current flowing therethrough when one of said thermal detectors has a surrounding temperature there around changing from a normal temperature to a predetermined temperature;

a plurality of actuator units electrically connected in series, wherein each of which comprises an actuating piece made of thermostatic metal, a conducting terminal piece connected to said actuating piece, an insulating sleeve covering a portion of said actuating piece, and an electrical heat element wrapping around said insulating sleeve which has one end connected to said actuating piece; and a connecting circuit for electrically connecting said thermal detectors in parallel with said actuator units, wherein said connecting circuit comprises a first terminal, a second terminal, a first connecting wire electrically connected said thermal detectors between said first and second terminals, and a second connecting wire which is extended between said first and second terminals in parallel with said first connecting wire to electrically connect said actuator units between said first and second terminals, wherein a main current flowing through said input terminal and said output terminal is divided into said first current flowing through said thermal detectors and a second current flowing through said actuator units;

whereby when said first current of said first connecting wire flowing through said thermal detectors breaks, said main current completely flows through said second connecting wire via said electrical heat elements of said actuator units so as to increase temperature around said actuating pieces until each of said actuating pieces provides an actuating action.

13. A thermal actuator, as recited in claim 12, wherein each of said thermal detectors enables said first current to flow therethrough again when said surrounding temperature around said respective thermal detector returns to said normal temperature, each of said thermal detectors comprising a first contact member made of electrical conducting material, a second contact member made of thermostatic metal and an insulating connector connected between a connecting end of said second contact member and said first contact member, wherein said second contact member is normally remained in contact with said first contact member, however when said surrounding temperature around said respective thermal detector reaches said predetermined temperature, said contact member bends away from said first contact member to uncontact with said first contact member.

14. A thermal actuator, as recited in claim 13, wherein on said second contact member of each of said thermal detectors, a circular convex groove is formed, so that when said second contact member is heated by a hot surrounding, said circular convex groove ensures said contact end of said second contact member bending away from said respective first contact member.

15. A thermal actuator, as recited in claim 14, wherein an end of said first contact member protrudes a first contact point facing to said second contact member and said second contact member has a contact end which protrudes a contact point arranged to normally in contact with said first contact point.

16. A thermal actuator, as recited in claim 12, wherein said first current contains more than 50% of said main current said second current contains less than 50% of said main current.

17. A thermal actuator, as recited in claim 15, wherein said first current contains more than 50% of said main current said second current contains less than 50% of said main current.

18. A thermal actuator, as recited in claim 12, wherein said first current contains 90% or more than said main current said second current contains 10% or less than said main current.

19. A thermal actuator, as recited in claim 13, wherein said first current contains 90% or more than said main current said second current contains 10% or less than said main current.

20. A thermal actuator, as recited in claim 14, wherein said first current contains 90% or more than said main current said second current contains 10% or less than said main current.

* * * * *